US006371335B1

(12) United States Patent
MacEwen

(10) Patent No.: US 6,371,335 B1
(45) Date of Patent: Apr. 16, 2002

(54) FOLDED END CONSTRUCTION FOR FOOD SAUCE DISPENSING CARTRIDGES

(75) Inventor: George Edward MacEwen, Kansas City, MO (US)

(73) Assignee: Sealright Co., Inc., Desoto, KS (US)

( * ) Notice: Subject to any disclaimer, the term of this patent is extended or adjusted under 35 U.S.C. 154(b) by 0 days.

(21) Appl. No.: 09/732,065

(22) Filed: Dec. 7, 2000

(51) Int. Cl.[7] ..... B65D 88/54
(52) U.S. Cl. ..... 222/327; 220/620
(58) Field of Search ..... 222/327, 391; 220/620

(56) References Cited

U.S. PATENT DOCUMENTS

| | | | | | |
|---|---|---|---|---|---|
| 132,895 | A | | 11/1872 | Bruson | |
| RE13,433 | E | | 6/1912 | Comings | |
| 1,607,923 | A | | 11/1926 | Sebell | |
| 1,643,252 | A | | 9/1927 | McCrery | |
| 1,645,016 | A | * | 10/1927 | Moore | 220/620 |
| 1,796,075 | A | | 3/1931 | Blixt | |
| 1,870,903 | A | * | 8/1932 | Giesler | 220/620 |
| 3,583,624 | A | | 6/1971 | Peacock | |
| 3,800,994 | A | | 4/1974 | Bowen et al. | |
| 4,303,190 | A | | 12/1981 | Ditto et al. | |
| 4,373,646 | A | | 2/1983 | MacEwen | |
| 4,432,473 | A | | 2/1984 | MacEwen | |
| 4,830,231 | A | | 5/1989 | Smith | |
| 4,892,214 | A | * | 1/1990 | Hamaguchi et al. | 220/620 |
| 6,032,823 | A | | 3/2000 | Bacon | |

* cited by examiner

*Primary Examiner*—Philippe Derakshani
(74) *Attorney, Agent, or Firm*—Shook, Hardy & Bacon L.L.P.

(57) ABSTRACT

An end disk construction and connection for food sauce dispensing cartridges and other food containers. An end disk through which food sauce may be dispensed is fitted in the dispensing end of a cartridge that holds the sauce. The disk initially has a projecting peripheral skirt which fits against the side wall of the cartridge. The end portion of the cartridge wall is crimped inwardly to fold the skirt into a lip which is doubled over on the peripheral area of the disk. The flange formed by the inwardly folded wall portion encloses the lip and its raw edge to isolate the edge from the food sauce. A bond is effected between the disk and the cartridge wall and flange by thermoplastic coating on the disk and cartridge body which is heated during the crimping process.

20 Claims, 1 Drawing Sheet

FOLDED END CONSTRUCTION FOR FOOD SAUCE DISPENSING CARTRIDGES

FIELD OF THE INVENTION

This invention relates generally to the dispensing of food sauces and other foods and more particularly to an improved end construction for sauce dispensing cartridges.

BACKGROUND OF THE INVENTION

Fast service restaurants and other food service facilities use various types of food sauces that are applied to sandwiches and other foods. Due to the large volume of customers that are served by fast service restaurant chains, the sauces must be dispensed repeatedly in carefully controlled portions each containing a relatively small amount of sauce. Particularly in applications of this type, it has proven to be convenient for the sauces to be packaged in cartridge dispensers from which the sauce is dispensed using handheld dispensing guns. The amount of sauce that is dispensed is controlled by providing suitable valving in the dispensing end of the cartridge and using a dispensing gun that advances a plug in the cartridge a consistent distance each time the dispensing gun trigger is squeezed.

Examples of the type of dispensing cartridges that have been used include U.S. Pat. No. 4,432,473 to MacEwen and U.S. Pat. No. 4,830,231 to Smith. Although cartridges of this type have functioned well for the most part, there is room for improvement, particularly with respect to the construction of the bottom disk and its connection with the body of the cartridge.

It has been common practice in the past to use "hot melt" adhesive to glue the end disk to the inside of the cartridge wall. Such adhesives are typically applied to the inside surface of the disk and cartridge wall where they are in contact with the food sauce contained by the cartridge. Accordingly, the adhesive must meet food grade standards. Such adhesives are relatively expensive and also complicate the manufacturing process due to the need for the adhesive to be heated and accurately applied. The adhesive must be applied in a bead or fillet completely around the periphery of the disk in order to prevent leakage of sauce past the edge of the disk. Also, the raw edge of the disk must be isolated from the sauce by the adhesive in order to prevent the sauce from "wicking" into the paperboard edge of the disk. Many adhesives do not exhibit good temperature or chemical resistance properties, which limits the types of products that can be packaged in the cartridge. The end disk constructions that have been used in the past in dispensing cartridges normally recess the disk a significant distance inwardly from the end of the cartridge body. Because the food sauce can be filled only to the end disk, the volume of the cartridge body located beyond the disk is unavailable to hold the sauce. When pressure is applied to the end disk during dispensing of the sauce, the disk can bow or otherwise deform because of the relatively weak construction of the disk itself and particularly its connection with the cartridge body. This flexure can create problems in the dispensing of the sauce.

SUMMARY OF THE INVENTION

The present invention is directed to a food sauce dispensing cartridge that has an improved end disk construction. More specifically, the invention is characterized by an end disk that is initially positioned inside the dispensing end of the cartridge body with a peripheral skirt lying along the inside of the cartridge body wall and the end portion of the cartridge wall extending beyond the skirt. The wall end portion is crimped or folded inwardly to lie along the outwardly facing surface of the end disk. This folds the skirt into the form of a lip which is doubled over onto the peripheral portion of the disk. Heat is applied during the crimping process to melt the thermplastic which coats the surfaces of the disk and cartridge wall. When the thermoplastic cools, it forms an effective heat seal between the disk and the cartridge body.

The folded or crimped end portion of the cartridge wall provides an in turned flange which is heat sealed to the lip on the disk and to the main disk surface. The disk sandwiches the lip and its raw edge between the main disk surface and the flange so that the raw paperboard edge of the disk is enclosed. This isolates the disk edge from the product contained within the cartridge body. Further, a strong connection is provided because the fold on the periphery of the disk is heat sealed to the cartridge wall and the flange on the cartridge body is heat sealed to the lip and to the main surface of the disk. The folded over lip provides an extra layer of paperboard at the connection area, and the flange provides still another layer of material that strengthens the connection and reduces the tendency for the end disk to bow or otherwise deflect when the sauce is being dispensed.

This construction eliminates the need for costly "hot melt" adhesive and also provides better temperature and chemical resistance than cartridges that use such adhesives. The cartridge has a substantially flat end configuration so that the disk is adjacent to the end of the cartridge body, thus making the entire length of the cartridge available to hold the food sauce. Wicking of the food sauce into the raw edge of the disk cannot occur because the disk edge is completely enclosed by the folded flange. The overall result is that the dispensing cartridge is economical to make, exhibits good temperature and chemical resistance, has enhanced strength, and provides more volume than cartridges with recessed end disks.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
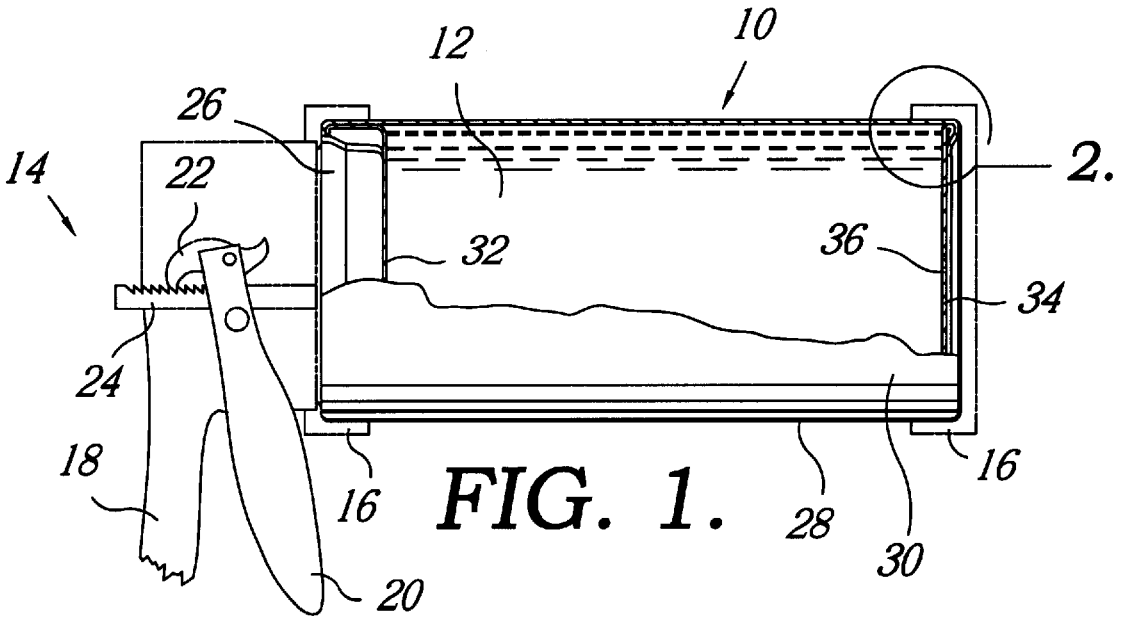
FIG. 1 is a side elevational view of a food sauce dispensing cartridge constructed according to a preferred embodiment of the present invention, with the cartridge applied to a dispensing gun and a portion of the cartridge wall broken away for purposes of illustration.

Referring now to the drawings in more detail and initially to FIG. 1 in particular, numeral 10 generally designates a food sauce dispensing cartridge constructed in accordance with a preferred embodiment of the present invention. Food sauce 12 is packaged in the cartridge 10 and is dispensed in measured quantities from the cartridge by a handheld dispensing gun 14. The dispensing gun 14 has a pair of flanged plates 16 between which the cartridge 10 is held. The dispensing gun 14 has a handle 18 and a trigger 20 which may be squeezed to operate the dispensing gun. A pawl 22 is connected with the trigger 20 and acts against a ratchet 24 when the trigger 20 is squeezed. The ratchet 24 takes the form of a bar which carries a plunger 26 on one end. Each time the trigger 20 is squeezed, the interaction between the pawl 22 and ratchet 24 advances the plunger 26 into the cartridge 10 a predetermined distance in order to dispense the food sauce 12. The construction and operation of the dispensing gun 14 is described in more detail in U.S. Pat. No. 4,432,473 to which reference may be made for a thorough description of the dispensing gun.

The dispensing cartridge 10 has a body 28 which is formed by a cylindrical side wall 30. The side wall 30 is preferably a foil laminated food grade paperboard that is coated on both its inside and outside surfaces with thermoplastic 31 (FIGS. 2 and 3), preferably polyethylene. The body 28 may be formed by rolling the paperboard into the shape of a cylinder and providing an overlap or seam area (not shown) which is suitably secured to form a leakproof container.

One end of the cartridge body 28 is provided with a plug 32 which closes the end of the cartridge and may be advanced into the cartridge body toward the opposite end when the plunger 26 of the dispensing gun is advanced against the plug.

The opposite end of the cartridge body 28 is the end through which the sauce 12 is dispensed. The dispensing end is provided with an end disk 34. The disk 34 may be provided with one or more valve openings 36 through which the food sauce 12 is dispensed each time the plug 32 is advanced toward the end disk 34 through operation of the dispensing gun 14. The food sauce 12 is discharged through the outlet or outlets 36 in a precise amount that is dependent upon the distance the plug 32 advances when the dispensing gun is operated. The plunger 26 is advanced a consistent amount each time the trigger 20 is squeezed, so that the same amount of food sauce 12 is discharged through the outlet or outlets 36 each time the dispensing gun is operated.

Figure 3:
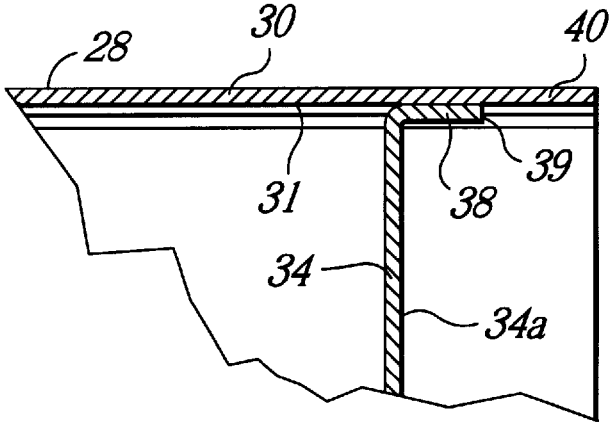
FIG. 3 is a fragmentary sectional view similar to FIG. 2, but showing the end disk applied in the end portion of the cartridge prior to the cartridge end being folded or crimped inwardly and heat sealed to complete the end construction of the cartridge.

The present invention relates to the construction of the end disk 34 and the manner in which it is connected with the side wall 30 of the cartridge body 28. With reference to FIG. 3 in particular, the end disk 34 is initially provided in the form of a flat circular panel having a peripheral skirt 38 turned from the main body of the disk 34 at a 90° angle. The diameter of the disk 34 is such that the skirt 38 fits closely against the inside surface of the cartridge wall 30 when the disk is inserted into the dispensing end of the cartridge body 28. The disk 34 and skirt 38 are preferably constructed as an integral unit, with the skirt 38 bent from the peripheral edge portion of the disk body. The skirt terminates in an edge 39 that is typically at lest partly paperboard. Preferably, the disk 34 and skirt 38 are constructed of foil laminated food grade paperboard coated on both surfaces with thermoplastic 37 such as polyethylene.

The disk 34 is initially positioned inside of the cartridge side wall 30 at the approximate location shown in FIG. 3. The disk 34 is recessed a selected distance inwardly from the end of the cartridge body 28 such that an extending end portion 40 of the side wall 30 extends beyond the location of the main body of the disk 34 and the edge 39 of the skirt 38.

Figure 2:
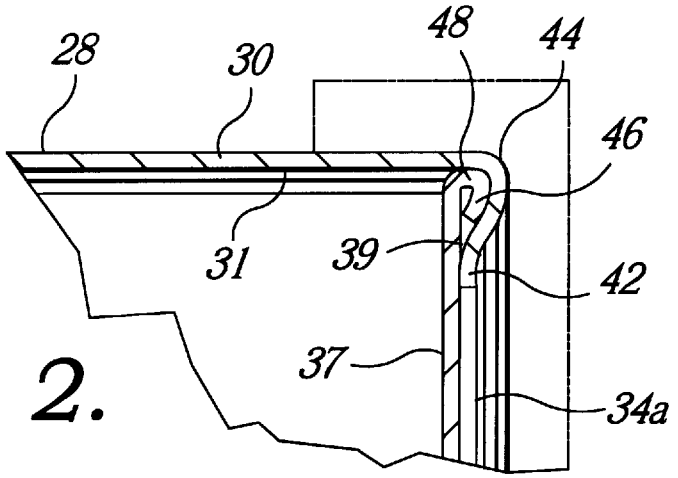
FIG. 2 is a fragmentary sectional view on an enlarged scale showing the detail identified by numeral 2 in FIG. 1.

With the disk 34 located in the position of FIG. 3 and held in that position, the extending end portion 40 of the side wall 30 is crimped or folded radially inwardly until it lies along the outwardly facing surface 34*a* of the end disk 34. After the crimping operation has been completed, the inwardly folded end portion 40 of the side wall 30 is formed into a flange 42 as shown in FIG. 2. The flange 42 is crimped or folded inwardly about a shoulder 44 which is located close to the disk 34 at the intersection between the main portion of the side wall 30 and the inwardly turned flange 42.

With continued reference to FIG. 2 in particular, crimping of the flange 42 inwardly from the side wall 30 results in the skirt 38 being folded inwardly or doubled back onto the exposed or outwardly facing surface 34*a* of the disk 34 to form a folded lip 46. The lip 46 provides a double layer of material at the location of the connection between the disk 34 and the cartridge body 28. The lip 46 is doubled back onto the disk 34 at a fold 48 located adjacent to the end of the side wall 30 immediately inwardly of the crimped shoulder 44.

Before flange 42 has been crimped inwardly, heat is applied to the flange 42, the adjacent area of the side wall 30 and to the peripheral area of the disk 34 and the lip 46 and fold 48. The application of heat causes the thermoplastic coating 31 on the inside of the side wall 30 and flange 42 to melt, and it also causes the thermoplastic coating 37 on the peripheral area of the disk 34 and the lip 46 and fold 48 to melt. When the cartridge thereafter cools, the thermoplastic creates a heat seal and bonds the flange 42 to the lip 46 and the adjacent outer surface of the disk 34, as shown in FIG. 2. In addition, the fold 48 is sealed to the inside of the end of the side wall 30 and the inside of the crimped shoulder 44. The end of the flange 42 extends inwardly beyond the edge 39 of the disk and is heat sealed and bonded to the main body of the disk 34 at a location inwardly from the edge 39. The lip 46 and edge 39 are thus enclosed between the flange 42 on one side and the main body of the disk 34 on the other side. The seal of the fold 48 against the side wall 30 and the inside of the shoulder 44 isolates the edge 39 from the food sauce 12 contained within the cartridge body 28. The thermoplastic 31 and 37, after it has melted and cooled, creates a bond between the flange 42 and the lip 46 and disk 44, and a similar bond is created by the thermoplastic between the fold 48 and the cartridge side wall 30 and shoulder 44. This bond creates an effective seal of the interior of the cartridge and also a strong connection between the cartridge body 28 and the disk 34. In addition to the overlap or double layer provided by the in turned lip 46, the in turned flange 42 provides another layer of material that reinforces and strengthens the peripheral area of the disk 34 and its connection with the cartridge body 28. As a result, the disk 34 is better able to resist a tendency to bow or deflect when it is subjected to pressure during dispensing of food sauce 12.

The disk 34 is located adjacent to the dispensing end of the container side wall 30. Therefore, the cartridge 10 presents a flat end construction, and substantially the entire length of the cartridge body 28 is available to hold the food sauce 12. It is noted that the end disk construction and connection arrangement of the present invention eliminates the need to use "hot melt" adhesive or other adhesives in order to secure the end disk in place. This reduces the cost to manufacture the cartridge and also provides the cartridge with better temperature and chemical resistance which is inhibited by the need for hot melt adhesives in cartridges that have been used in the past.

Although the invention has been described in connection with an end construction for a cartridge dispenser for food sauce, it has utility in other applications that involve the packaging of foods. For example, the end construction may be used for the bottom of a food container or the lid of for a food container.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

Having thus described the invention, what is claimed is:

1. A cartridge for holding and dispensing food sauce, comprising:

a generally cylindrical body having opposite first and second ends and an interior for holding food sauce;

a plug in said body adjacent the first end thereof adapted to be advanced in said body toward the second end thereof to dispense the food sauce;

an end disk in said body adjacent the second end thereof and having an exposed surface and a dispensing outlet for dispensing of the food sauce;

a peripheral lip on said end disk folded to lie generally along said exposed surface and terminating in an edge adjacent to said exposed surface; and a flange on said second end of the body folded to sandwich said lip between said exposed surface and said flange and to enclose said edge, said flange being sealed to said end disk.

2. A cartridge as set forth in claim 1, wherein said flange is sealed to said lip and to said exposed surface.

3. A cartridge as set forth in claim 2, wherein said flange is heat sealed to said lip and to said exposed surface.

4. A cartridge as set forth in claim 2, wherein said flange and disk are coated with a thermoplastic material which is heated to melt and bond said flange to said lip and exposed surface.

5. A cartridge as set forth in claim 1, including a fold at which said lip is folded from said disk, said fold being sealed to said body.

6. A cartridge as set forth in claim 5, wherein said fold is heat sealed to said body.

7. A cartridge as set forth in claim 5, wherein said disk and body are coated with a thermoplastic material which is heated to melt and bond said fold to said body.

8. A cartridge as set forth in claim 5, wherein said flange is sealed to said lip and to said exposed surface.

9. A cartridge as set forth in claim 8, wherein said fold is heat sealed to said body and said flange is heat sealed to said lip and exposed surface.

10. An end construction for a generally cylindrical cartridge body from which food sauce is dispensed, said end construction comprising:

an end disk in said cartridge body adjacent a dispensing end thereof, said disk having a dispensing outlet for dispensing food sauce from said cartridge body and an exposed surface facing away from the food sauce contained in said body:

a peripheral lip on said disk folded therefrom to extend generally along said exposed surface, said lip terminating in an edge adjacent to said exposed surface in abutment therewith; and a flange on said dispensing end of said cartridge body folded therefrom to enclose said lip and the edge thereof between said flange and said exposed surface, said flange being secured to said end disk.

11. An end construction as set forth in claim 10, wherein said flange is sealed to said end disk.

12. An end construction as set forth in claim 11, wherein said flange is heat sealed to said end disk.

13. An end construction as set forth in claim 10, wherein said flange is heat sealed to said lip and said exposed surface.

14. An end construction as set forth in claim 13, wherein said flange and end disk are coated with a thermoplastic material which is heated to melt and bond said flange to said lip and exposed surface.

15. An end construction as set forth in claim 10, including a fold at which said lip is folded from said disk, said fold being heat sealed to said cartridge body.

16. In a structure used for the packaging of food, the improvement comprising:

a side wall;

an end panel located within said side wall, said panel having an inside surface facing the food and an exposed outside surface facing away from the food;

a peripheral lip on said panel folded therefrom to extend generally along said outside surface and terminating in an edge located adjacent to said outside surface in abutment therewith; and a flange on said side wall folded therefrom to extend along said end panel and sealed to said panel at a location to enclose said lip and the edge thereof between said flange and said outside surface of said end panel.

17. The improvement of claim 16, wherein said flange is heat sealed to said end panel.

18. The improvement of claim 17, wherein said flange is heat sealed to said lip and to said outside surface of said panel.

19. The improvement of claim 18, wherein said flange and end panel are coated with a thermoplastic material which is heated to melt and bond said flange to said lip and outside surface.

20. The improvement of claim 16, including a fold at which said lip is folded from said end panel, said fold being heat sealed to said side wall.

* * * * *